US005713422A

United States Patent [19]

Dhindsa

[11] Patent Number: 5,713,422

[45] Date of Patent: Feb. 3, 1998

[54] APPARATUS AND METHOD FOR DRILLING BOREHOLES

[76] Inventor: Jasbir S. Dhindsa, 1239 Sugar Creek Blvd., Sugar Land, Tex. 77478

[21] Appl. No.: 202,377

[22] Filed: Feb. 28, 1994

[51] Int. Cl.[6] ..... E21B 44/00; E21B 19/08

[52] U.S. Cl. ..... 175/27; 173/4; 254/273

[58] Field of Search ..... 175/24, 27, 51; 173/4, 5; 73/151.5; 254/267–275

[56] References Cited

U.S. PATENT DOCUMENTS

| | | | |
|---|---|---|---|
| 2,005,889 | 6/1935 | Dillon et al. | 173/5 X |
| 3,605,919 | 9/1971 | Bromell et al. | 175/27 |
| 3,746,102 | 7/1973 | Griffin, III et al. | 173/4 |
| 4,195,699 | 4/1980 | Rodgers et al. | 175/27 |
| 4,434,971 | 3/1984 | Cordrey | 175/27 X |
| 4,491,186 | 1/1985 | Alder | 175/27 X |
| 4,662,608 | 5/1987 | Ball | 175/27 X |
| 4,854,397 | 8/1989 | Warren et al. | 175/27 X |
| 4,875,530 | 10/1989 | Frink et al. | 175/27 |
| 5,474,142 | 12/1995 | Bowden | 175/27 |

*Primary Examiner*—David J. Bagnell

*Attorney, Agent, or Firm*—Madan & Morris

[57] ABSTRACT

The present invention provides a drilling system for drilling a borehole. A motor continuously coupled to the drawworks may be utilized to raise and lower a drill stem to continuously control the weight on bit at a desired value. A second motor rotates the drill stem. A control circuit is coupled to both the motors and receives information from various sensors which includes information about the rate of penetration, weight on bit; hook load, and rotational speed of the drill bit. The control circuit controls the drawworks motor to control the drill stem motion in both directions. In one mode the a desired rate of penetration is maintained by controlling the weight on bit. In another mode, the control circuit causes the drilling to start at an initial rate of penetration and then it starts to vary the rate of penetration according to programmed instructions to optimize the drilling efficiency. Yet, in another mode the control circuit causes the drilling to start at initial rotary speed and the weight on bit values and then varies the weight on bit and/or the rotary speed to obtain the combination of these parameters that yields the most efficient drilling of the borehole. If a mud motor is used to drill a borehole, the control circuit may be programmed to control drilling as a function of the differential pressure across the mud motor.

17 Claims, 9 Drawing Sheets

APPARATUS AND METHOD FOR DRILLING BOREHOLES

BACKGROUND OF THE INVENTION

1. Field of the Invention

This invention relates generally to an apparatus and a method for drilling wells, and more particularly to an apparatus and a method for automatically optimizing the drilling rate of a borehole.

2. Background of the Related Art

To drill a borehole into the earth, such as for producing oil and gas, a drill stem is rotated by a prime mover, such as an electric motor (herein referred to as the "rotary motor"). The drill stem contains a pipe which has a drill bit at its bottom end. A silicon control rectifier ("SCR") based control circuit (sometimes referred to in the art as a "drive ") is frequently used to regulate power to the rotary motor to control the rotational speed of the drill stem. During drilling, the total weight of the drill stem (some times referred to as the "hook load") may exceed several thousand pounds. To drill a borehole into the earth, the drill stem is rotated at a desired speed while maintaining only a portion of the hook load on the drill bit (commonly referred to as the "weight on bit" or "WOB"). The combination of the WOB and the drill stem rotational are the key parameters that determine the drilling rate or the rate of penetration ("ROP"). Other factors, such as the formation characteristics, mud type and flow characteristics contribute to the drilling efficiency.

The top end of the drill stem (the end opposite to the drill bit end) is coupled to a cable or line, which line is spooled on a drum via a system of pulleys. A prime mover, such as an electric motor (referred to herein as the "drawworks motor") is coupled to the drum via a transmission and clutch mechanism to rotate the drum. An operator engages a friction brake with the drum to prevent the drum from rotating when the drawworks motor is not engaged with the drum. The combination of the drum, brake, and transmission and clutch mechanism is generally referred to in the art as the "drawworks." To move the drill stem upward, the operator engages the drawworks motor with the drum, disengages the friction brake from the drum and causes an SCR control drive to rotate the drawworks motor to rotate the drum to pull up the drill stem. To lower the drill stem into the borehole, the operator engages the brake with the drum, disengages the drawworks motor from the drum, and then manually releases the brake from the drum. As the brake is released from the drum, the weight of the drill stem causes the drum to unwind, thereby lowering the drill stem.

Until the present, the drawworks motors are used only to lift or raise the drill stem and are disengaged during drilling. Thus methods used to control the WOB, whether manual or automatic use the friction brake to hold the drill stem weight. Thus, the control of the drill stem during drilling is unidirectional, i.e., lowering the drill stem. The present invention provides apparatus and method wherein the drawworks motor is engaged at all times during drilling and it is controlled to operate in both the directions (to raise and lower the drill stem) the drill stem. The system of the invention provides continuous control of the drill stem, greater flexibility to change the operating parameters and enables to hold the WOB to closer tolerances compared to the prior art methods.

To start drilling, the operator powers up the rotary motor to rotate the drill stem at a predetermined speed and then using the brake lowers the drill stem into the borehole and attempts to maintain the WOB to a predetermined value (typically between 20,000 lbs. to 50,000 lbs.). If, however, the operator needs to ream the borehole back and forth, the operator engages the brake to the drum, reduces the rotational speed of the drill stem, engages the drawworks motor to the drum, disengages the brake from the drum and causes the drawworks motor to rotate the raise the drill stem. The above described manner to drill a borehole and the manual control of the brake to control the WOB are cumbersome, inefficient, are not able to accurately control the WOB and do not result in optimal drilling rates.

Occasionally during drilling, the drill stem gets stuck due to excessive WOB and/or other borehole conditions. However, the rotary motor continues to run (until it is turned off), which continues to increase the torque on the drill stem to its limit, at which point the drill stem speed starts to reduce toward zero and the drill pipe gets wound up and occasionally breaks. To unwind the drill pipe, the operator first must unwind the pipe to a low torque value, stop the rotary motor, engage the drawworks to lift the drill stem. If the drill pipe breaks, the drill stem must be fished out of the borehole, which can take several days and can cost several thousand dollars in expenses and lost time. There exists a need in the art to have an apparatus and method which prevents the WOB to exceed a predetermined limit and which is adapted to sense the occurrence of certain adverse operating conditions and in response to such sensed conditions automatically reduces the WOB to prevent the drill bit from getting stuck in the borehole.

To better control the WOB, servo motors have been used to lower the drill stem. Servo motors also use the friction brake to hold the drill stem to control the WOB. Since the brake can only hold the drill stem weight, there is no means to reduce the WOB once it exceeds the desired value. As the brake, pulleys and the drill pipe affect the accuracy, this method is crude and does not respond to dynamic drilling conditions.

Furthermore, the rotary motor operates independent of the drawworks operation. To change the drill stem rotational speed, the operator accordingly causes the power to the rotary motor to change. To optimize the penetration rate, the operator typically performs what is referred to as a "drill-off" test. During the drilling operation, the operator performs drilling utilizing several combinations of the WOB and rotational speed of the drill stem for short time periods and then selects the combination which has resulted in the highest penetration rate to continue drilling.

The above described apparatus and drilling methods do not provide optimal drilling of a borehole for a given type of drill-bit under the dynamic operating conditions and changing formations during drilling nor do they automatically aid in averting extreme conditions from occurring, such as a stuck-bit condition.

The present invention addresses some of the above noted problems and provides a drilling system which may be used in various modes to provide more efficient drilling than provided by the above-noted prior art methods. The system of the invention also continually monitors the operating conditions and when certain undesired conditions are present, it automatically reacts to avert extreme conditions from occurring, such as the stuck bit condition.

SUMMARY OF THE INVENTION

The present invention provides a drilling system for drilling a borehole. The system contains a drill stem having a drill bit at its one end for drilling the borehole. A drawworks containing a drum having a line spooled thereon and coupled to the drill stem controls the upward and downward motions of the drill stem. A drawworks motor is coupled to the drawworks for rotating the drum in both the clockwise and counterclockwise directions. A rotary motor is coupled to the drill stem for providing rotational speed to the drill stem. A control circuit controls the operation of the drawworks and the rotary motor. The control circuit receives information from various sensors which includes information about the rate of penetration, weight on bit, hook load, and rotational speed of the drill bit. During operation, the control circuit controls the rotation of the drawworks to control the upward and downward motions of the drill stem. In one mode the control circuit maintains a desired rate of penetration and if the weight on bit exceeds an upper limit, it reduces the rate of penetration by reducing the unwinding speed of the drum. In another mode of operation, the control circuit causes the drilling to start at an initial rate of penetration and then starts to vary the rate of penetration according to programmed instructions to optimize the drilling efficiency. In another mode of operation the control circuit causes the drilling to start at initial rotary speed and the weight on bit values and then varies the weight on bit and/or the rotary speed to obtain the combination of these parameters that yields the most efficient drilling of the borehole. If a mud motor is used to drill a borehole, the control circuit may be programmed to control drilling as a function of the differential pressure across the mud motor. Examples of more important features of the invention have been summarized above rather broadly in order that the detailed description thereof that follows may be better understood, and in order that the contribution to the art may be better appreciated. There are, of course, many additional features of the invention that will be described in detail hereinafter and which will form the subject of the claims appended hereto.

BRIEF DESCRIPTION OF THE DRAWINGS

For detailed understanding of the present invention, references should be made to the following detailed description taken in conjunction with the following drawings in which like elements have been given like numerals.

DESCRIPTION OF THE PREFERRED EMBODIMENT

The drilling system of the present invention contains a drill stem for drilling a borehole (well) into the earth, a first prime mover for rotating the drill stem, a drawworks coupled to the drill stem for raising and lowering the drill stem, a second prime mover for operating the drawworks, a plurality of sensors for providing information about various parameters of the drilling system and a control circuit for controlling the operation of the drilling system and for displaying information about the operation of the drilling system.

Figure 1:
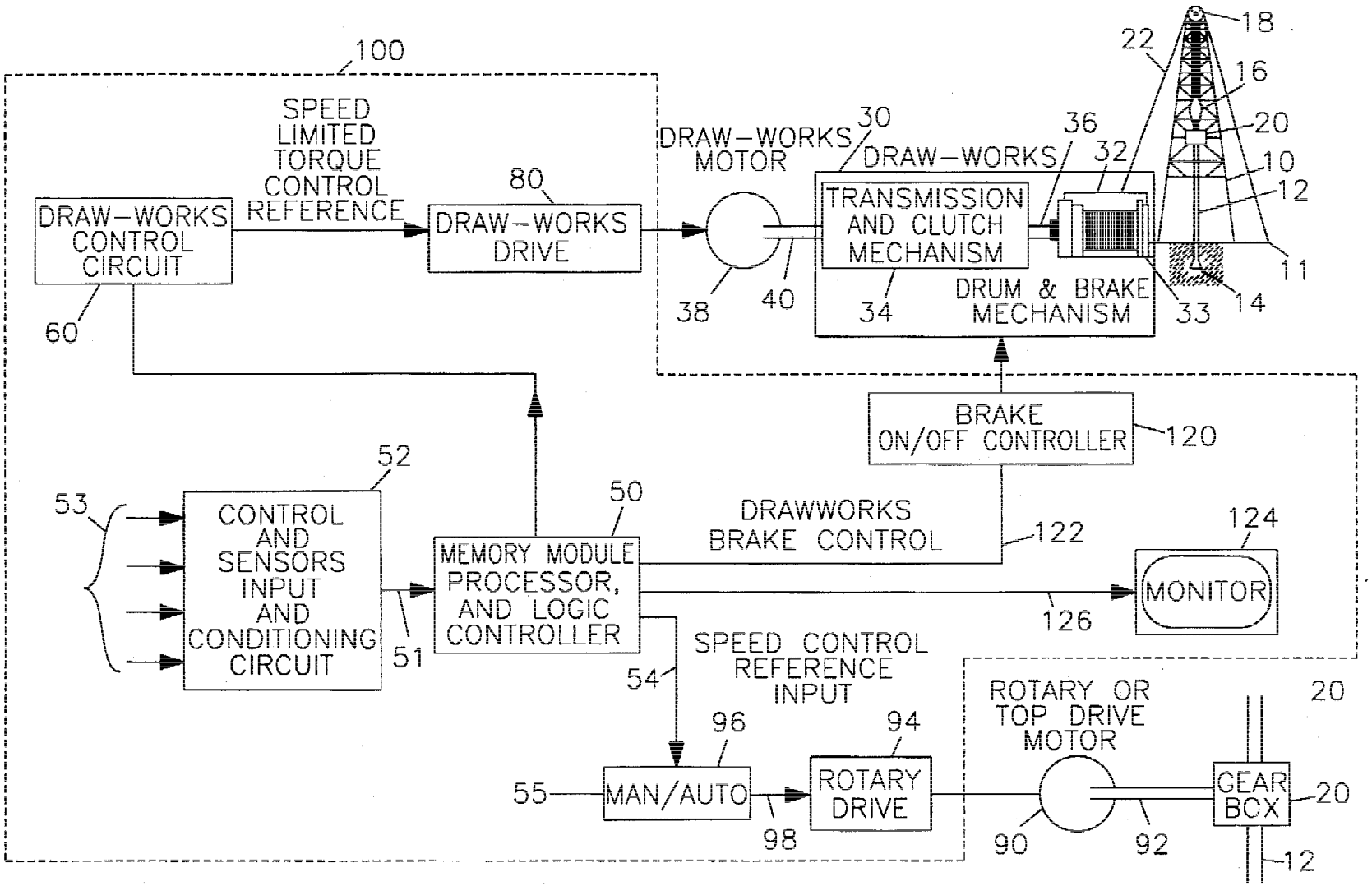
FIG. 1 shows a functional block diagram of the drilling system according to the present invention.

FIG. 1 shows an embodiment of the drilling system according to the present invention. This drilling system contains a support structure 10, such as a derrick. A drill stem 12 having a drill bit 14 at its bottom end is coupled to a prime mover 90 via a gear box 20 for rotating the drill stem 12. The prime mover 90 is preferably an electric motor. The electric motor may be a d.c. or an a.c. type motor and it may be either the rotary or top drive type motor. For simplicity and not as a limitation, the prime mover 90 is hereafter referred to as the "rotary motor." The rotary motor 90 is adapted to rotate the drill stem 12 in both the clock-wise and counter clock-wise directions.

The top end of the drill stem 12 is coupled to a cable or line 22 via a system of pulleys 18. One end of the line 22 is anchored at a suitable place 11 on the support structure 10 while the other end of the cable 22 is wound on a drum 32 of a drawworks 30. The drawworks 30 contains the drum 32, which is coupled to a transmission and clutch mechanism 34 via a coupling member 36, and a friction brake 33. The transmission and clutch mechanism 34 contains different levels, wherein the lowest level defines the least rotational speed range for the drum 32 and the highest level defines the highest speed range for the drum 32. The transmission and clutch mechanism 34 engages with the drum 32 via the coupling member 36. During drilling, the clutch and transmission are set at the low clutch and low speed gears. If more than one D.C. motor is used to operate the drawworks, their armature are connected in series.

A prime mover 38 coupled to the transmission and clutch mechanism 34 is adapted to rotate the drum 32 in both the clock-wise and counter clock-wise directions when the clutch and transmission mechanism 34 is engaged with the drum 32. An electric motor (d.c. or a.c. motor) is preferably used as the prime mover 38. For simplicity and not as a limitation the prime mover 38 is hereafter referred to as the "drawworks motor." When the clutch and the transmission mechanism 34 is disengaged from the drum 32, the drawworks motor 38 has no affect on the drum 32. When the brake 33 is fully engaged with the drum 32, it prevents the drum 32 from rotating. When the drawworks motor 38 is disengaged from the drum 32 and the brake 32 is controllably released, the weight of the drill stem 12 (the hook load) causes the drum 32 to rotate to unwind the cable 22 from the drum, thus lowering the drill stem 12.

In the present invention, drilling may be accomplished in a number of modes, which are more fully explained below. A control circuit 100, shown contained in the dotted lines, controls the operation of the drilling system of FIG. 1 in each of the drilling modes. For simplicity and clarity and not as a limitation, the control circuit 100 is shown as a functional block diagram in order to describe the control logic used for the drilling system. The detailed circuits for various aspects of the control circuit 100 may be designed in any number of ways known in the electrical engineering art.

The control circuit 100 contains a microcontroller circuit 50 for controlling the operation of the drilling system of FIG. 1, a plurality of sensors (not shown) for providing information about various system parameters, a control and sensor input and conditioning circuit 52, a display means 124 for displaying information about various parameters and operating conditions of the drilling system, a drawworks control circuit 60 for providing control signals to a drawworks drive 80 in response to the operating conditions and according to the programmed instructions for controlling the drawworks motor 38, a rotary drive 94 for controlling the operation of the rotary motor 90, a drawworks brake on/off circuit 120 for controlling the operation of the brake 33 and other circuits to monitor and display the desired parameters and operating conditions of the drilling system.

The microcontroller circuit 50 may contain one or more microcontrollers or microprocessors, logic circuits, memory elements and programmed instructions. The use of microprocessor based circuits is known in the electrical engineering art and, therefore, is not be described in detail.

As noted earlier, the control circuit 100 contains a number of sensors, which provide signals or information relating to various parameters of the drilling system. The control circuit 100 may include sensors for providing information representative of: the total weight of the drill stem 12 (the hook-load); the speed of the line 22; rate of penetration the drill stem 12 (the "drilling rate" or the "rate of penetration" or "ROP"); torque on the drill stem 12; rotational speed of the drill stem 12; and rotational speeds of the drawworks motor 38 and the rotary motor 90. Additionally, the control circuit 100 contains means that provides signals to the microcontroller circuit 50 which are representative of the conditions of various elements of the drilling system, such as whether the brake 33 is engaged with the drum 32, whether the input current and voltages are applied to the motors 38 and 90, whether the drill stem 12 is stuck in the borehole, etc. Additionally, the control circuit contains means which define the maximum limits of various parameters, such as the ROP, WOB, differential pressure across the drill bit when a mud pump is used, rotational speeds of the motors, torque on the drill stem and upward and downward speeds of the drill stem. The signals from the various sensors are input or applied to the control and sensor input and conditioning circuit 52 via input ports 53. The circuit 52 conditions the received signals and passes the conditioned signals to the microcontroller circuit 50 via a bus or conductor 51. The microcontroller circuit 50 processes the information received from the circuit 52 and other elements of the circuit 100 and controls the operation of the drilling system according to the programmed instructions for the mode of operation that has been selected.

As noted above, the present invention provides a number of modes for performing drilling operations. These modes of operation are described in below. In each such mode, the operation is controlled by controlling the operation of the drawworks motor 38 and the operation of the rotary motor 90

The microcontroller circuit 50 controls the speed of the rotary motor 90, which rotates the drill stem 12 and thus the drill bit 14. The microcontroller circuit 50 provides to a manual/automatic ("man/auto") circuit 96 on conductor 54 a signal representative of the desired speed of the motor 90 and a signal representative of maximum rotational speed of the rotary motor 90.

If the drilling system is set to operate in the automatic mode, the circuit 96 provides an output signal to line 98 representative of the desired speed of the motor 90 constrained by the maximum speed set by the microcontroller circuit 50. The signal from the circuit 96 is applied to a rotary drive 94. The circuit 94 interacts with the speed control signal and causes the rotary motor to rotate in the desired direction at the desired speed. The rotary drive 94 is preferably an SCR based circuit, like the circuit 80. The SCR based circuits to control large motors used for drilling wells and other applications have been known in the electrical engineering art and thus they are not described in detail here. The circuit 94 regulates power to the motor 90 causing it to rotate at a desired speed. The rotary motor 90 is coupled to the drill stem 12 via a gear box 20 or some other desired means. Sensors (not shown) coupled to the rotary motor 90 and drill stem 12 respectively provide information about the rotational speed of the rotary motor 90 and the drill stem 12.

The microcontroller circuit 50 also controls the engaging and disengaging of the friction brake 33 with the drum 32. The microcontroller circuit 50 provides a signal via conductor 122 to a brake control circuit 120, which causes the brake to engage or disengage as instructed by the microcontroller circuit 50. The microcontroller circuit 50 is further coupled to a monitor 124 for providing information to an operator about various parameters and the operating conditions of various elements of the drilling system of FIG. 1. Such parameters and the operating conditions may include, the hook load, weight on the bit, penetration rate, bit depth, tension on the line 22, torque on the drill stem, stuck bit condition and whether the brake is engaged or disengaged with the drum 22. The stuck bit condition may be defined as the condition when the rotational speed of the drill stem is below a predetermined value and the torque on the drill stem is above a predetermined value. Other convenient definitions may also be used.

A. Weight On Bit Method

Figure 1A:
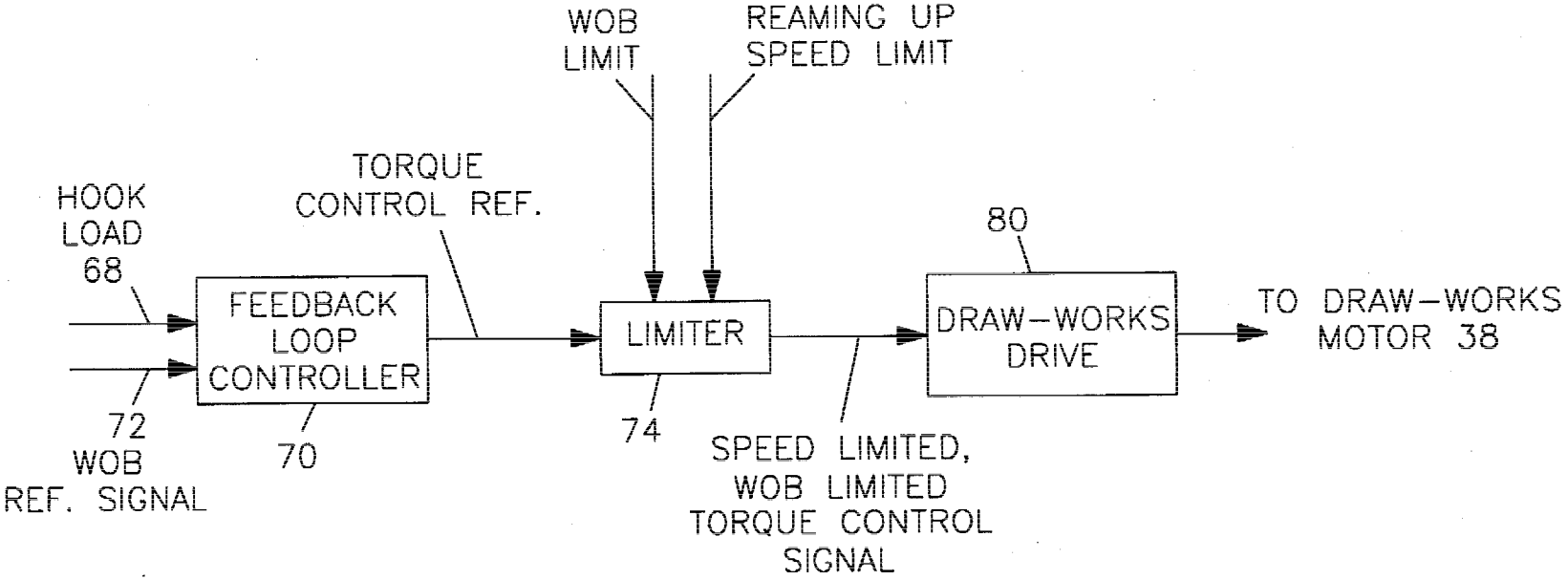
FIG. 1A shows the functional block diagram of the Drawworks control circuit of FIG. 1 when the WOB method is used to perform drilling of a borehole.

In the Weight on Bit method or mode (the "WOB" method or mode), the drawworks 30 is controlled so as to continually maintain the desired WOB during drilling. The operation of the drilling system in the WOB Method is described below while referring to FIGS. 1, 1A and 2.

The signals representative of the hook load and the desired WOB from the microcontroller circuit 50 are applied respectively via conductors 68 and 72 to a feed back loop controller circuit 70. The feed back loop controller circuit 70 provides an error signal (referred to as the torque control signal) which represents the amount by which the WOB needs to be changed. Typically, a decreasing torque control signal would indicate that the weight on the bit 14 needs to be increased and an increasing signal would mean that the weight on the bit 14 needs to be decreased. The torque control signal from the circuit 70, a downward speed limit signal and an upward speed limit signal from the microcontroller circuit 50 are applied to a limiter circuit 74, which provides as an output a speed limited torque signal, i.e., a signal that is within the predetermined band defined by the upward and the downward speed limit signals. The speed limited torque control signal is applied to a control drive 80. The drawworks drive 80 contains a silicon control rectifier (SCR) based circuit which coacts with the speed limited torque control signal from the speed limiter 74 to provide desired power to the drawworks motor 38 to cause it to rotate and provide braking torque, thereby causing the drum 32 to rotate in the desired direction by a desired amount when the clutch 34 is engaged with the drum 32 and the brake 33 is disengaged from the drum 32. The rotation of the drum 32 raises or lowers the drill stem continuously depending upon the direction of rotation of the drum 32.

Figures 1, 2:
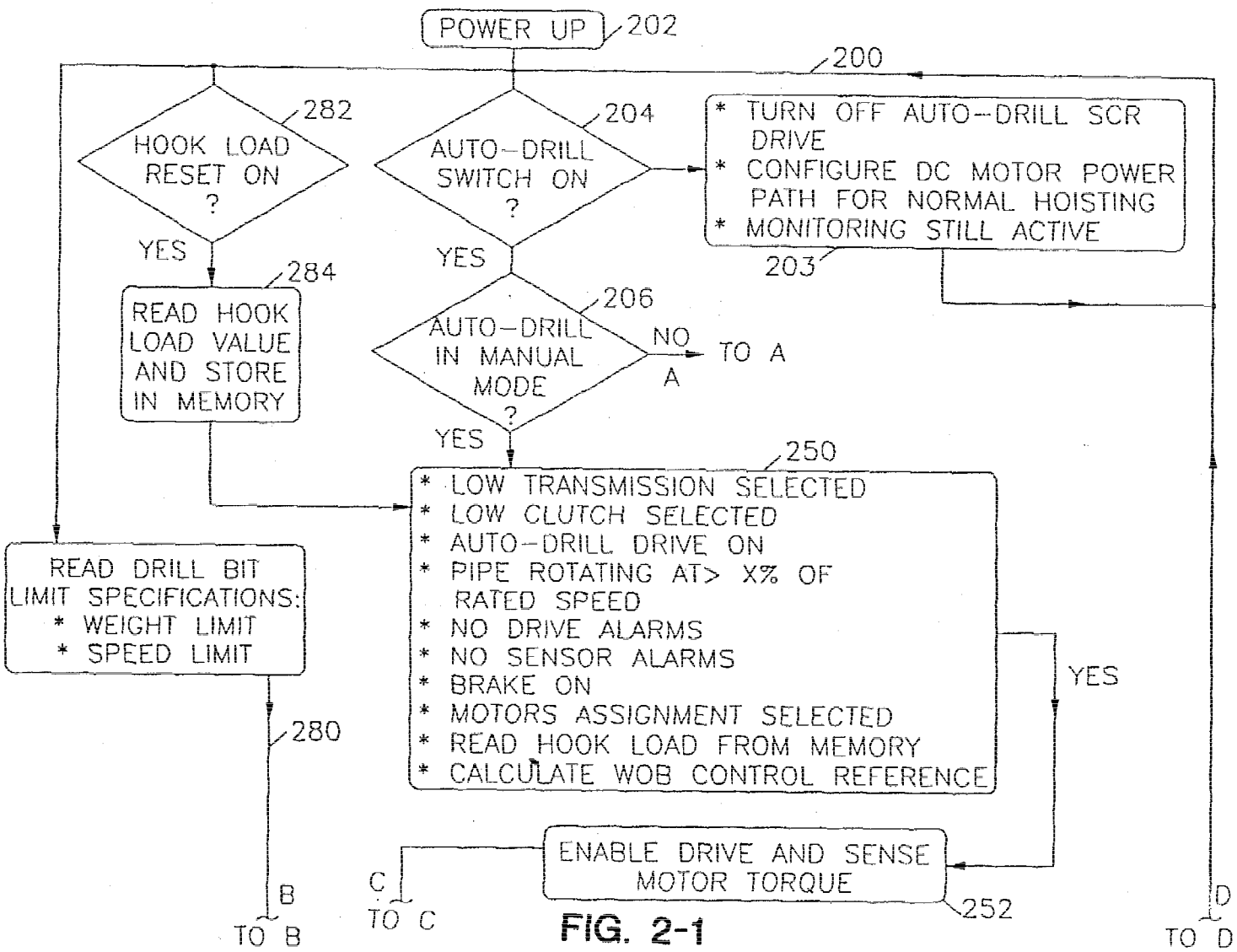
FIG. 2 shows a flow chart depicting the operation of the drilling system of FIG. 1 when the WOB method is used for drilling a borehole.
Figure 2:
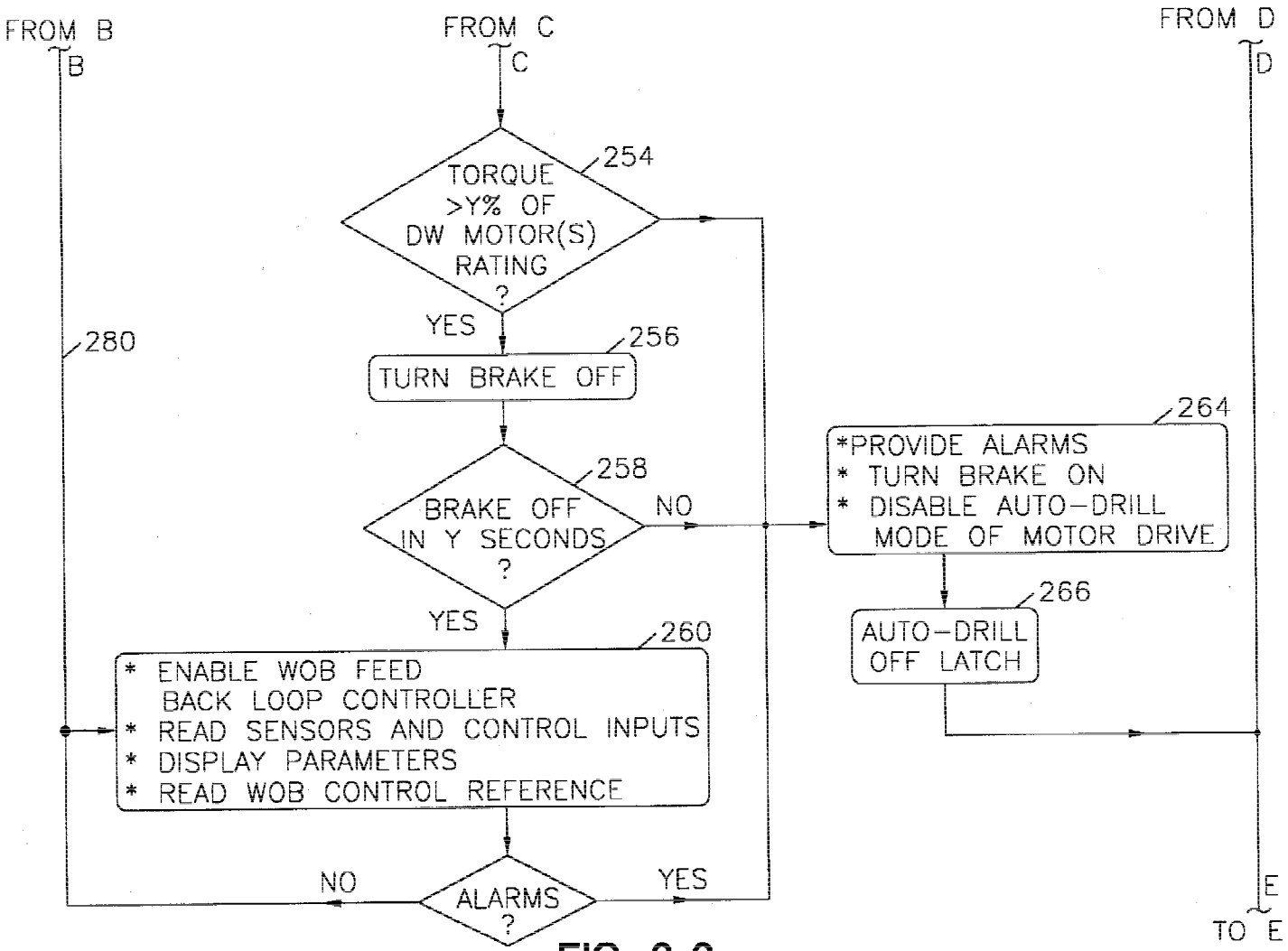
Figures 2, 3:
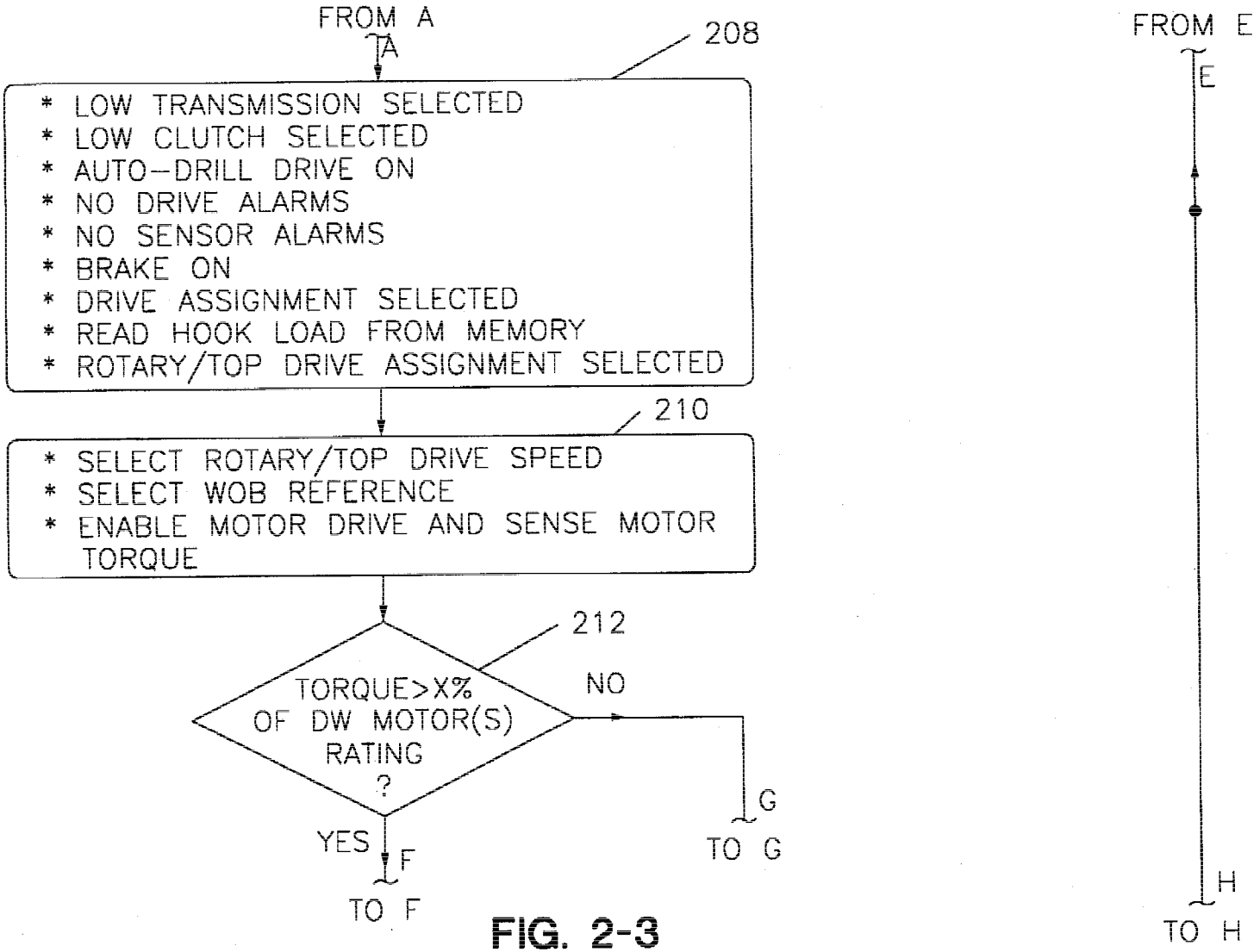
Figures 2, 3, 4:
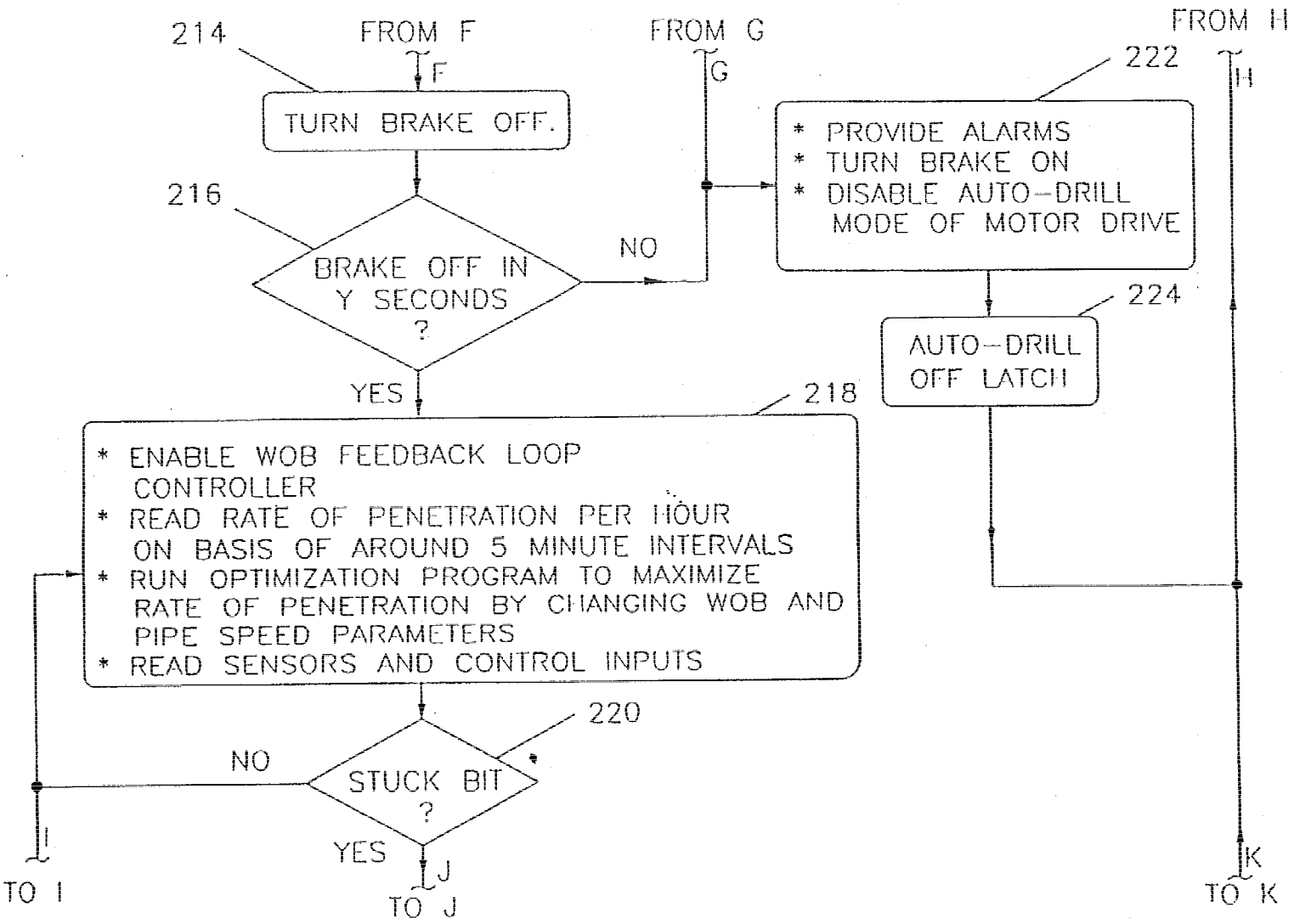
Figures 2, 3, 4, 5:
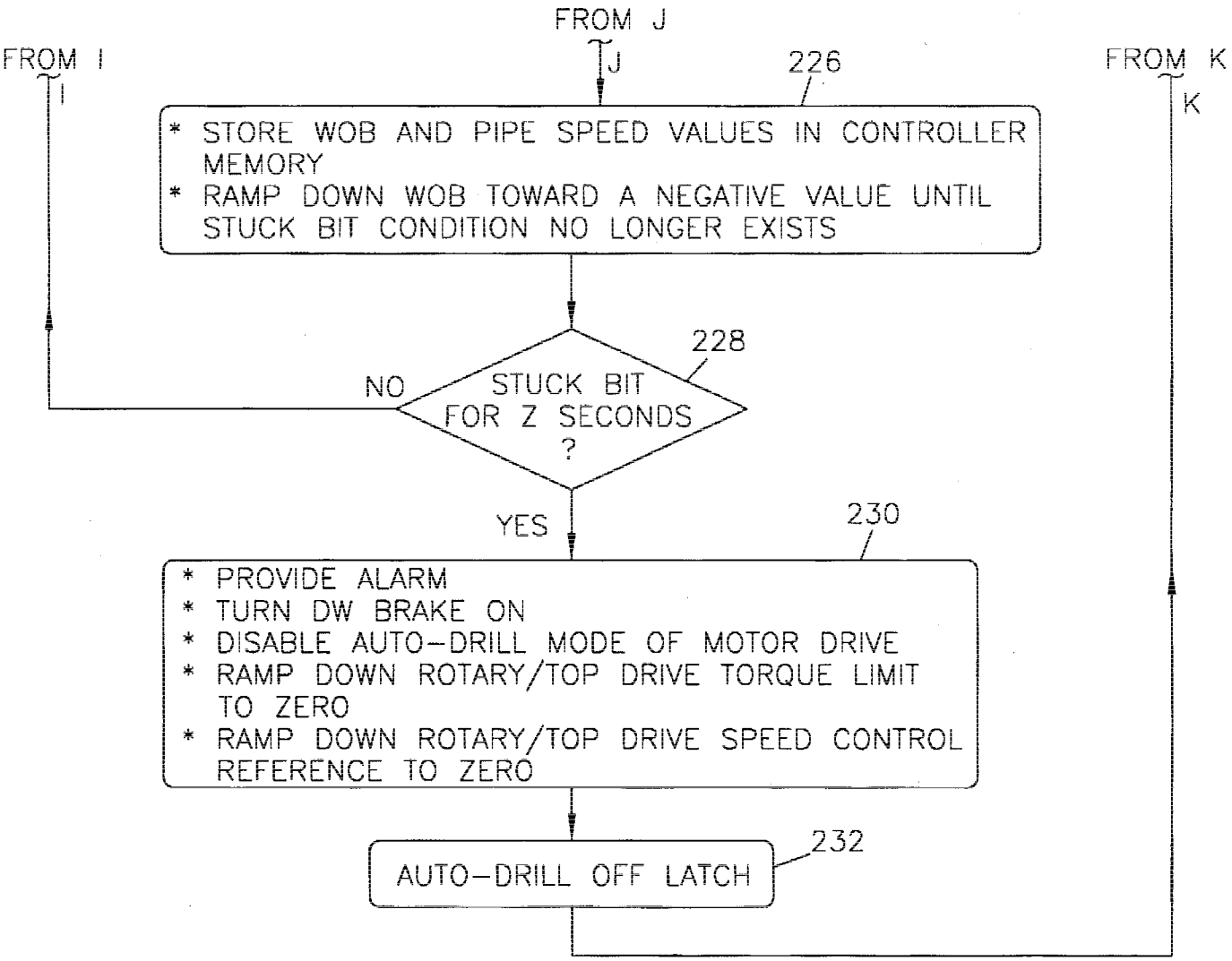

FIG. 2 is a flow chart which shows some of the functions performed by the drilling system of FIG. 1 when it is operated in the WOB mode. The operation of the drilling system in the WOB mode will now be described while referring to FIGS. 1 and 2. The drilling system of FIG. 1 is designed to control the drawworks in either a manual mode or in an automatic or "auto" mode. It is considered helpful to first describe the operation when the drilling system is set to operate in the auto mode.

In the auto mode, the drilling system: (a) maintains the WOB to a value by automatically raising and lowering the drill stem as needed in response to certain sensed conditions and in accordance with instructions provided to the control circuit 50; (b) varies the rotational speed of the drill stem by controlling the operation of the motor 90 in response to certain sensed conditions and instructions provided to the microcontroller circuit 50; (c) automatically raises the drill stem when certain predetermined conditions occur to avert the drill stem from getting stuck in the borehole; (d) engages the brake 33 to the drum and turns off the drawworks motor 38 when certain predetermined conditions occur; (e) automatically provides alarm when certain unsafe conditions occur and (f) continuously provides information about various system parameters.

The initial or start values of certain system parameters, such as the initial WOB, initial rotational speed of the drill bit are provided to microcontroller circuit 50 by a software means which contains the control logic shown in FIG. 2.

When the drilling system of FIG. 1 is turned on (powered-up), the microcontroller circuit 50 checks whether the drilling system is set to operate in the manual mode or auto mode. If the drilling system is set to operate in the auto mode, the microcontroller circuit 50 ensures that all preconditions defined for the drilling system in block 208 are met before it causes the drilling system to operate. As shown in block 208, these preconditions may include: that the transmission and clutch 34 are in their respective low positions; that the drives 80 and 94 are in their respective on positions, i.e., the power to these drives is on; that there are no alarms (drive alarms, sensor alarms, etc.) on; and that the brake 33 is fully engaged with the drum 32. Additionally, the microcontroller circuit 50 ensures that the proper assignment for the drive 94 is selected and that inputs from the various sensors are being received as required.

Once the microcontroller circuit 50 determines that all the preconditions such as defined in block 208 have been met, it causes the drilling operation to begin by controlling and/or setting the parameters such as shown in block 210. As shown in block 210, the microcontroller circuit 50 selects the initial rotational speed of the drill stem 12, for example about thirty percent (30%) of the maximum rated speed, selects the initial (reference) WOB, for example about twenty percent (20%) of the maximum rated value, and causes the drill stem 12 to rotate at the initial speed. At this point, the brake 33 is on, i.e., the drum 32 is not rotating but the drill stem 12 is rotating at its initial rotational speed. The microcontroller circuit 50 then causes the drawworks drive 80 to operate the motor 38 and when the torque of the drum 32 exceeds a predetermined value, for example thirty percent (30%) of the rated value, it causes the brake 33 to release from the drum 32. If the brake 33 does not release within a short time period, for example four (4) seconds, such as due to lack of air pressure to operate the brake or because of some other mechanical or electrical problem, the microcontroller circuit 50 engages the brake 33 to the drum 32, activates an alarm indicating that there exists a system failure and disables the auto mode. On the other hand, if no problems are encountered, the microcontroller circuit 50 continuously adjusts (lowers or raises) the drill stem 12 so that the WOB and the rotary speed equal their respective starting drilling values.

The software means, whether resident in the microcontroller circuit 50 or external thereto or a combination of both, contains instructions for operating the drilling system of FIG. 1. The software means contains the logic steps shown in FIG. 2 and/or other similar and/or equivalent steps. The software means also contains instructions, algorithms defining how the operating parameters, such as the WOB and rotary speed, will be varied during the drilling operation. Such parameters may be defined by a desired algorithm or stored in tabular form, sometimes referred to in the art as the look-up tables. The software means causes the drilling system to start the operation at initial values of WOB and rotary speed of the drill stem 12. The microcontroller circuit 50 monitors the various system parameters and determines the rate of penetration (ROP). The microcontroller circuit 50 then changes the values of the WOB and/or rotary speed, causes the drilling system to operate at these new parameter values for a predetermined time and computes the ROP at such new parameter values. If the new ROP is greater than the immediately ROP, the microcontroller circuit 50 again changes the WOB and/or the rotary speed as defined by the control logic contained in the software means and causes the drilling system to operate at such parameters for a time period and computes the new ROP. As long as the new ROP is greater than the immediately preceding ROP, the drilling system may be programmed to increase the WOB and/or the rotary speed up to a maximum limit of each such parameter. In this manner, the drilling system continually hunts for the highest ROP within the defined limits. If, however, the ROP for a particular combination of the WOB and the rotary speed is less than the immediately preceding penetration rate, the drilling system reverts back to such preceding penetration rate. For the purpose of explanation and not as a limitation, an example of a control logic for operating the drilling system of FIG. 1 is given below.

As an example and not as a way of limitation, assume that the starting WOB is 5000 lbs. and the starting rotary speed is 100 rpm. The drilling system may be programmed to perform drilling at these parameters for a time period, for example ten (10) seconds and compute/determine the penetration rate. Then the system may increase the WOB to the next incremental value, for example, 5500 lbs. The system then performs drilling at 5500 lbs. WOB and 100 rpm. rotary speed for a predetermined period, for example ten (10) seconds. If the penetration rate is greater than the preceding penetration rate at 5000 lbs. WOB and 100 rpm. rotary speed, the system then changes these parameters to the next defined state by the software means. For example, the next state may be defined as 5500 lbs. WOB and 110 rpm. rotary speed. In this manner, the microcontroller circuit 50 will cause the drilling system to hunt for the highest penetration rate. The system may be programmed to then continue the drilling at this highest penetration rate for a predetermined time period or for drilling the entire borehole or until the penetration rate decreases by a certain amount. Alternatively, the drilling system may be programmed to continue to vary the WOB and/or the rotary speed. If the penetration rate falls for a certain combination of the WOB and the rotary speed, the system may be programmed to automatically revert to the previous combination that provided the highest penetration rate.

Regardless of the logic used, the drawworks 30 remains engaged to the drawworks motor 38 and the control circuit 100 continuously controls the motion of the drill stem (up and down) by controlling the drawworks motor 38 and the rotary speed by controlling the rotary motor 90. Furthermore, the microcontroller circuit 50 continuously monitors the various system parameters and provides information about such parameters via the monitor 124 or via some other suitable means. The control circuit also causes the appropriate alarms to go on when certain predetermined conditions occur. Such conditions may include a struck-bit condition, brake failure, sensor failure, etc.

When the microcontroller circuit 50 detects a struck-bit condition, e.g., when the torque on the drill stem 12 exceeds a preset maximum value, the microcontroller circuit 50 stores in its memory the values of the WOB and the rotary speed and ramps down the WOB toward a predetermined value, e.g., negative 10,000 lbs. and, thus, automatically raising the drill stem 12 until the drill stem 12 no longer exhibits the struck-bit condition (see block 226). If the struck-bit condition is not averted within a predetermined time period, e.g, ten (10) seconds, the microcontroller circuit 50 activates the appropriate alarms, engages the friction brake 33 to the drum 32, disables the drawworks motor 38 and the rotary motor 90, ramps down the rotary drive torque limit to zero, ramps down the rotary speed control reference to zero and sets other parameters to their defined values to ensure safety of the drilling system.

Referring back to block 202 of FIG. 2, if on turning on the power, the microcontroller circuit 50 determines that the system has been set to operate in the manual mode (see block 206), it then controls the operation of the drawworks, i.e, raising or lowering of the drill stem 12 as depicted in blocks 250 through 266.

In the manual mode, as in the auto mode, the microcontroller circuit 50 ensures that the defined preconditions for the manual mode are met before starting the drilling operation. For example, these preconditions may include that the transmission and the clutch are at their respective low settings, the drill stem is rotating at a certain speed, e.g., greater than ten percent (10%) of the rated speed, there are no alarm conditions present, all sensors are providing proper inputs and that the friction brake 33 is fully engaged with the drum 32.

Once the microcontroller circuit 50 ensures that all the preconditions have been met, it controls the WOB according to the logic programmed for the drilling system. In the manual mode, the control system does not control the rotary motor.

B. Rate of Penetration Method

Figure 1B:
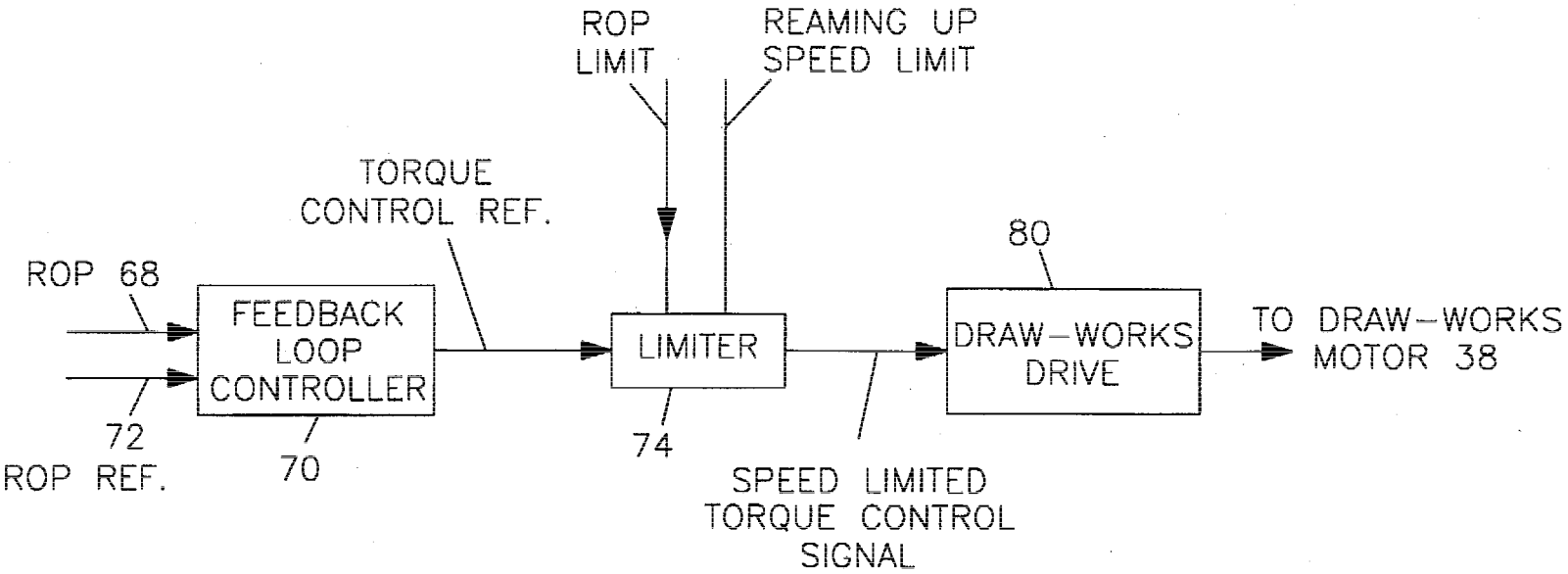
FIG. 1B shows the functional block diagram of the Drawworks control circuit of FIG. 1 when ROP method is used for drilling a borehole.

The operation during the Rate of Penetration (ROP) method or mode is described below while referring to FIGS. 1, and 1B. A signal corresponding to the actual ROP, which may be determined from the motor voltage or a tachometer or another sensor employed for such purpose and a reference ROP signal are applied to the feed back loop controller 70. The output of the circuit 70 is a torque control signal, which is applied to the limiter 74 in the manner as described earlier with respect to the WOB method. The limiter provides a WOB limited torque control signal, which controls the rotation of the drawworks motor 90.

In the ROP mode, an initial ROP and the maximum ROP are defied for the system. At the start of the drilling operation, the drill stem 12 is rotated at a predetermined rotational speed and the drawworks drum 32 is rotated to lower the drill stem 12 at the initial ROP. As the drilling continues, the ROP is maintained at a constant value and the WOB automatically starts to adjust for that ROP. This is because the drill stem is being lowered at the constant ROP and it is being rotated at a constant speed. If the WOB exceeds the maximum WOB value, the control circuit 100 overrides the set ROP value and reduces the ROP by slowing down the drawworks motor. The ROP is reduced until the WOB falls below its maximum limit. As the formations under the earth's surface change as the drilling depth changes, the WOB may vary significantly from one formation to the next for the same ROP. In one aspect of the ROP mode, the system may be programmed so that it automatically increases the ROP up to a maximum limit by increasing the speed of the drawworks motor as long as the WOB remains below the maximum limit or below some other predetermined value. This method will provide the highest drilling rate for a given type of drill-bit, a given rotational drill stem speed and within the defined WOB limits. In another aspect of the ROP mode, the system may be programmed to vary the WOB and/or the drill stem rotational speed to achieve the combination that will provide the most efficient drilling.

The control logic for detecting and averting the adverse conditions, such as the stuck-bit condition, and the operation of the rotary motor are the same as described above with respect to the WOB mode.

C. Differential Pressure Control Method

In certain drilling operations, especially for drilling horizontal wells, the drill stem contains a hydraulic motor (also referred to as the downhole drilling motor) which operates due to a differential pressure across the downhole drilling motor ("Dp") to rotate the drill bit. In such drilling operations, the drawworks control circuit 60 controls the drawworks so as to maintain a constant Dp across the down hole drilling motor.

Figure 1C:
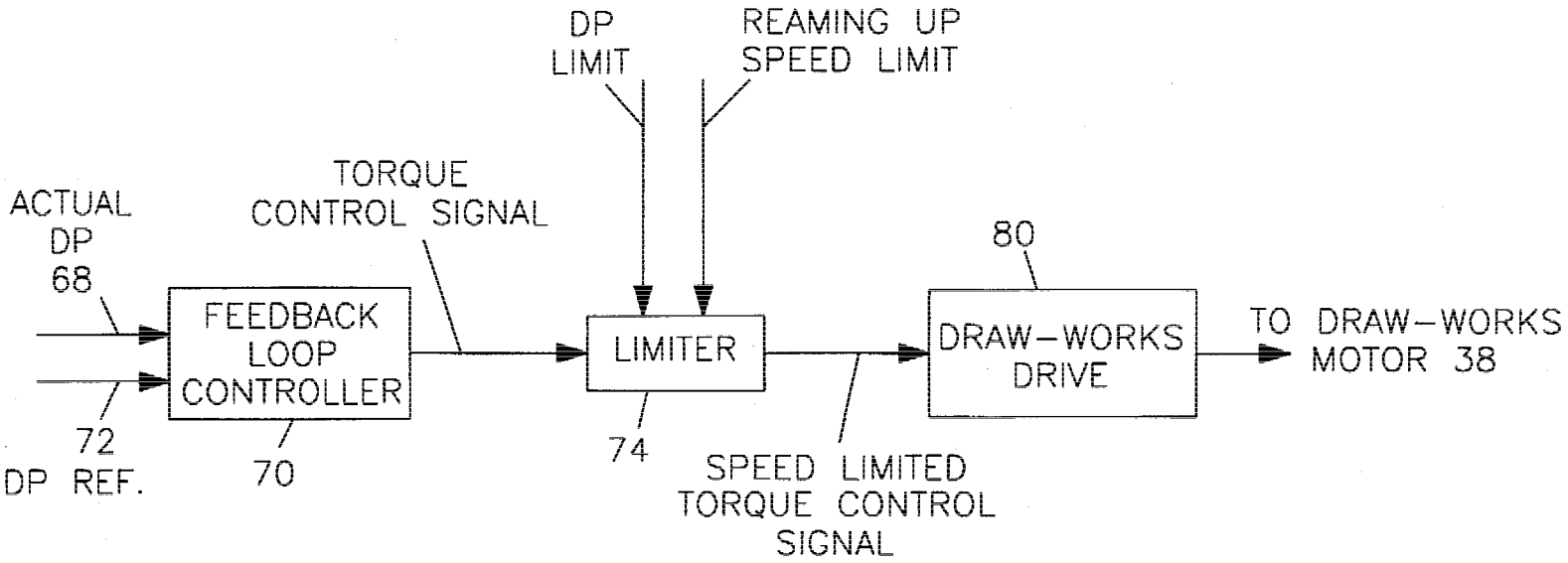
FIG. 1C shows the functional block diagram of the Drawworks control circuit of FIG. 1 when the differential pressure method is used for drilling a borehole.

A signal corresponding to the actual Dp and a reference DP value are respectively applied via conductors 68 and 72 to the to the feed back loop controller 70 (see FIG. 1C). The output of the circuit 70, as with the other modes of operation, is a torque control signal, which is applied to the limiter 74. The limiter a speed limited torque control signal which is a function of the actual Dp and the desired Dp. This signal is then applied to the drawworks drive 80, which causes the drawworks to raise or lower the drill stem so as to maintain the desired Dp across the downhole drilling motor.

The system may be programmed to automatically increase the Dp after the drilling has started, up to a maximum Dp limit. This may be accomplished by lowering the drill stem faster. Alternatively, the system may be programmed so as to maintain the Dp within a certain range, which may be accomplished by raising or lowering the drill stem as required. In this manner more efficient drilling may be obtained as the operating conditions change.

The control logic for detecting and averting the adverse conditions, such as the stuck-bit condition, and the operation of the rotary motor are the same as described above with respect to the WOB mode.

Under certain downhole conditions such as if a particular formation is too hard, the drill stem may continue to rotate without penetrating into the earth. However, as described above, during drilling the drawworks motor is continuously engaged with the drawworks and a d.c. motor is used as the drawworks motor, it should continue to rotate at a minimum speed otherwise the current passing through a particular commutator will exceed the maximum rating, which can damage the motor. To prevent this from happening, the control circuit continually detects whether or not the drawworks motor is rotating and if there is no motion for a predetermined time (for example ten (10) seconds), the control circuit changes one or more of the parameters to ensure that the d.c. motor continues to rotate. This may be accomplished by merely changing the WOB or by lifting the drill stem by a predetermined amount.

The foregoing description has been directed to a particular embodiments and methods of the invention for the purposes of illustration and explanation. It will be apparent, however, to those skilled in the art that many modifications and changes to the embodiment set forth here will be possible without departing from the scope and spirit of the invention. It is intended that the following claims be interpreted to embrace all such modifications and changes.

What is claimed is:

1. A system for drilling a borehole, comprising:

(a) a drill stem having a drill bit at one end for drilling the borehole;

(b) drawworks coupled to the drill stem;

(c) a prime mover engaged continuously to the drawworks during operation to cause the drawworks to move the drill stem upward and downward; and (d) a control circuit operatively coupled to the prime mover, said control circuit operating the prime mover so as to cause the drawworks to automatically move the drill stem in both the upward and downward directions in response to a selected system parameter.

2. The apparatus of claim 1, wherein the selected system parameter is rate of penetration of the drill stem in the borehole.

3. The apparatus of claim 1, wherein the selected system parameter is the weight on bit.

4. The apparatus of claim. 1, further comprising a downhole motor coupled to the drill bit for providing rotational power to the drill bit.

5. The apparatus of claim 4, wherein the selected system parameter is the differential pressure across a mud motor.

6. A control circuit for controlling drilling of a borehole by a drilling system having a drill stem with a drill bit at its one end and a drawworks containing a drum with a line spooled thereon and attached to the other end of the drill stem, said drum rotated by a motor continuously engaged to the drawworks during drilling, said control circuit comprising:

(a) means for determining values of a selected system parameter;

(b) a drawworks drive for controlling the speed of the motor in both clockwise and counterclockwise directions;

(c) a drawworks control circuit coupled to the drawworks drive for providing a torque control signal to the drawworks drive, said drawworks drive controlling speed and the direction of rotation of the motor in response to the torque control signal; and (d) a microcontroller circuit coupled to the drawworks control circuit, said microcontroller circuit receiving information about the selected system parameter and in response thereto causing the drawworks control circuit and thereby the motor to rotate the drum in both clockwise and counterclockwise directions so as to maintain the selected parameter at predetermined values.

7. A control circuit for controlling drilling of a borehole by a drilling system wherein a motor is continuously engaged to a drawworks that is adapted to raise and lower a drill stem in the borehole, said control circuit comprising:

(a) means for determining rate of penetration of the drill stem in the borehole during drilling of the borehole;

(b) a drawworks drive for controlling speed of the motor in both clockwise and counterclockwise directions;

(c) a drawworks control circuit coupled to the drawworks drive circuit, said drawworks control circuit providing a torque control signal to the drive circuit, said drive circuit controlling the speed and the direction of rotation of the motor in response to the torque control signal; and (d) a microcontroller circuit coupled to the drawworks control circuit, said microcontroller circuit receiving information about the rate of penetration and in response thereto automatically causing the the motor to operate the drawworks so as to maintain the rate of penetration at desired values.

8. A control circuit for controlling the drilling operation of a drilling system having a drill stem with a drill bit at its one end and a drawworks containing a drum with a line spooled thereon and attached to the other end of the drill stem, said drum rotated by a motor coupled thereto, said control circuit comprising:

(a) means for determining the value of the rate of the penetration of the drill stem into the borehole and weight on bit drilling and for defining a maximum value of weight on bit;

(b) a drive for controlling speed of the motor in both clockwise and counterclockwise directions;

(c) a drawworks control circuit coupled to the drive for providing a torque control signal to the drive for controlling the speed and direction of rotation of the motor in response to the torque control circuit; and (d) a microcontroller circuit coupled to the drawworks control circuit, said microcontroller circuit receiving information about the rate of penetration and in response thereto causing the drawworks control circuit and thereby the motor to continuously rotate the drum so as to maintain the rate of penetration at a desired value and to reduce the rate of penetration if the weight on bit exceeds the maximum value.

9. A method of drilling a borehole by utilizing a drill stem having a drill bit at an end thereof, said drill stem operable by a drawworks that is continuously engaged to a prime mover, comprising:

(a) initiating drilling of the borehole by rotating the drill stem;

(b) determining weight on bit;

(c) determining torque and rotational speed of the drill stem; and (d) operating the prime mover to reduce the weight on bit when the torque on the drill string is above a predetermined value and the rotational speed is below a predetermined value so as to prevent the drill bit from getting stuck in the borehole.

10. A method for drilling a borehole wherein a prime mover is continuously engaged to a drawworks for raising and lowering a drill stem having a drill bit at an end thereof, comprising:

(a) rotating the drill stem at an initial rotational speed;

(b) operating the prime mover to lower the drill bit into the borehole at a predetermined speed, said speed of the drill bit being referred to as the rate of penetration; and (c) operating the prime mover to decrease the rate of penetration if an adverse operating condition is determined.

11. The method as specified in claim 10, wherein the motor is a d.c. motor and the rate of penetration is determined from the voltage across the motor.

12. A The method as specified in claim 10, wherein the motor is an a.c. motor and the rate of penetration is determined from the frequency of the motor.

13. The method as specified in claim 12, further comprising the step of decreasing the weight on bit if the weight on bit reaches a predetermined maximum value.

14. A method for drilling a borehole by utilizing a drill stem having a drill bit at an end thereof, said drill stem operable by a drawworks that is continuously engaged to a prime mover, comprising:

(a) lowering the drill stem into the borehole to place the drill bit at the bottom of the borehole;

(b) rotating the drill stem at an initial rotational speed and having an initial weight on bit to start drilling the borehole;

(c) lowering the drill bit at a predetermined speed, said speed being referred to as the rate of penetration; and (d) automatically adjusting the weight on bit by operating the prime mover so as to maintain the drilling at a predetermined rate of penetration.

15. A method for drilling a borehole by utilizing a drill stem having a drill bit at an end thereof, said drill stem adapted to be moved into and out of the borehole by a drawworks that is continuously engaged to a prime mover, comprising:

(a) lowering the drill stem into the borehole to place the drill bit at the bottom of the borehole;

(b) rotating the drill stem at an initial rotational speed and having an initial weight on bit to start drilling the borehole;

(c) defining a maximum value for the weight on bit for the drill bit and a maximum value for rotational speed of the drill stem;

(d) lowering the drill bit into the borehole at a predetermined speed, said speed being referred to as the rate of penetration; and (e) periodically changing the weight on bit and the rotational speed of the drill stem according to programmed instructions to obtain a combination that provides a desired rate of penetration while maintaining the weight on bit and the rotational speed below their respective maximum values.

16. A system for drilling a borehole, comprising:

(a) a drill stem having a drill bit at one end for drilling the borehole;

(b) a drawworks coupled to the drill stem for moving the drill stem upwards and downward;

(c) a motor continuously engaged to the drawworks for operating the drawworks; and (d) a control circuit operatively coupled to the motor, said control circuit causing the motor to move the drill stem in the borehole at a predetermined rate of penetration, said control circuit further determining weight on bit and reducing the rate of penetration if the weight on bit reaches a predetermined maximum value.

17. A system for drilling a borehole, comprising:

(a) a drill stem having a drill bit at one end for drilling the borehole;

(b) a drawworks coupled to the drill stem for moving the drill stem upwards and downward;

(c) a first motor continuously engaged with the drawworks for operating the drawworks;

(d) a second motor for rotating the drill stem; and (e) a control circuit operatively coupled to the first and second motors, said control circuit causing the first motor to move the drill stem upward and downward and second motor to rotate the drill stem so as to maintain a selected system parameter within predetermined limits.

* * * * *